US007501567B1

(12) United States Patent
Spinazzola

(10) Patent No.: US 7,501,567 B1
(45) Date of Patent: Mar. 10, 2009

(54) ROTATION ACTIVATED DRUM TUNING SYSTEM

(76) Inventor: David Michael Spinazzola, 2201 233rd Ave. NE., Sammamish, WA (US) 98074

( * ) Notice: Subject to any disclaimer, the term of this patent is extended or adjusted under 35 U.S.C. 154(b) by 0 days.

(21) Appl. No.: 12/008,965

(22) Filed: Jan. 14, 2008

(51) Int. Cl.
*G10D 13/02* (2006.01)

(52) U.S. Cl. ..... 84/411 R

(58) Field of Classification Search ..... 84/421, 84/411 R, 413, 415
See application file for complete search history.

(56) References Cited

U.S. PATENT DOCUMENTS 5,739,448 A * 4/1998 Toscano ..... 84/413
6,365,811 B1 * 4/2002 Conta ..... 84/411 R

* cited by examiner

*Primary Examiner*—Kimberly R Lockett

(57) ABSTRACT

A drum tuning system which rotates clockwise or counter-clockwise to adjust the tension of a drum head fitted over the open end of a drum body. It utilizes a rotating ring having numerous opposing equally spaced vertically projecting tabs along the top of the body's diameter, each with inward facing wheels that ride on the horizontal surface of a separate inner hoop bearing down on the drum head. The rotating actuator ring is fitted with multiple radial cleats projecting from its outside diameter for grasping it. A radius plate having horizontal holes extends from the drum body, and a tool engages the radial cleats on the rotating actuator ring to facilitate rotation. Multiple adjustable eccentric lugs are used to raise and lower the drum camming mechanism in relation to the open end of the drum body where attached. Horizontal projecting links support the drum attached to suspension mounting systems.

9 Claims, 8 Drawing Sheets

ROTATION ACTIVATED DRUM TUNING SYSTEM

CROSS REFERENCE TO RELATED APPLICATIONS

| U.S. Pat. Nos. | | |
|---|---|---|
| 6,043,419 | Aug. 26, 1980 | Arbiter |
| 4,218,952 | Mar. 28, 2000 | Arbiter |
| 5,739,448 | Apr. 14, 1998 | Toscano |
| D350,362 | Sep. 6, 1994 | Fuji |
| D339,818 | Sep. 28, 1993 | Peterson |
| 7,138,574 | Nov. 21, 2006 | Spinazzola |
| 4,295,405 | Oct. 20, 1981 | Sleishman |
| 4,448,105 | May 15, 1984 | Cordes |
| 4,570,526 | Feb. 18, 1986 | Hoshino |
| 4,619,179 | Oct. 28, 1986 | Wright |
| 4,714,002 | Dec. 22, 1987 | Cleland |
| 5,410,938 | May 2, 1995 | Kurosaki |
| 5,587,544 | Dec. 24, 1996 | Fuji |
| 6,166,311 | Dec. 26, 2000 | Barrickman |
| 6,417,432 | Jul. 9, 2002 | Downing |
| D339,818 | Sep. 28, 1993 | Peterson |
| D350,362 | Sep. 6, 1995 | Fuji |

BACKGROUND OF THE INVENTION

The present invention relates to a novel and useful apparatus for tuning an acoustic drum. Drums are comprised of several simple components including a drum head, most commonly made of a plastic material called Mylar, which include a rigid rim, generally made of a metallic material. The drum shell; most often made of layers of laminated wood, lexan plastic, aluminum, fiberglass or carbon fiber and formed to a cylindrical shape with two open ends. The drum head is stretched over the drum shell by means of a multiplicity of evenly spaced bolts inserted through holes around the diameter of a ring often made of stamped steel, die cast zinc, aluminum or wood known as the hoop. These bolts are threaded into what are commonly referred to as lugs which are generally attached to the drum shell by bolts inserted though holes drilled into the drum shell. Evenly adjusting the tension of these individual bolts causes the drum head to be tuned either higher or lower in pitch.

The current and most commonly used method for tuning drums is a best depicted by U.S. Design Pat. No. Fuji D350,362. Referred to as the drum hoop, it has a plurality of evenly spaced holes in it for bolts to be inserted through in order to exert tension on the drum head, it's overall shape designed to fit over the drum head. U.S. Design Pat. No. D339,818 is an example of lugs which are fastened to the drum shell and serve as anchors for the bolts inserted through the drum hoop previously mentioned. The earliest designs of this current hoop are U.S. Pat. No. 794,658 dated Jul. 11, 1905 show a combination of L cross section or "angle iron" rings, one with the vertical with surface facing upward, the other overlapping the horizontal surface and its vertical surface facing downward with holes about the horizontal flange for clamping down the drumhead. U.S. Pat. No. 899,488 dated Sep. 22, 1908 having an inverted U shaped Cross Section with evenly spaced holes around its perimeter. The first early modern design is U.S. Pat. No. 1,609,940 dated Dec. 7, 1926 appears to be the one piece conterhoop having an "L" cross section with the horizontal flange having evenly spaced holes for clamping the drum head to the open end of the drum shell. U.S. Pat. No. 6,166,311 was designed as an improvement to the drum hoop, an inward facing horizontal annular surface at the top of the hoop provides protection to the bearing edge of the drum shell, and a byproduct is increased rigidity of the drum hoop.

To evenly apply tension to the drum head to set the correct pitch takes a great amount of time and skill, often being time consuming and frustrating. To deal with this, systems for tuning drums have been proposed simplify this common task. U.S. Pat. No. 6,043,419 is comprised of a large counter hoop with a plurality of inward facing slides angled to act as ramps which ride on rollers or matching opposing slides fastened to the drum shell. It is tuned by rotating the drum clockwise or counterclockwise using a rack and pinion activation system. This tuning system employs individual adjusting screws to be able to fine tune the drum to make up for irregularities in drum heads. U.S. Pat. No. 5,739,448 is comprised of an inverted J-shaped counterhoop, which engages an externally threaded, outwardly facing tuning rim surface on a tuning collar that is secured to the drum shell. Clockwise or counterclockwise rotation of the counterhoop is accomplished by a pair of gears, one for gross tuning, and one for fine tuning.

U.S. Pat. No. 6,043,419 is the original inventor's improvement over U.S. Pat. No. 6,043,419 which utilizes a V Clamping mechanism which engages a counterhoop which has downwardly and outwardly extending flange which bears on the drum head and a flanged shell hoop fastened to the drum shell, its flange portion inclined upwards and outwards. The V clamp ring which surrounds the drum shell and engages both the outwardly extending portions of the counterhoop and the shell hoop contains a breach, tightening a bolt connecting the breached area draws the two hoops together and applies tension to the drum head. Contraction of the V clamp ring exerts an inward compression force which draws the counter-hoop towards the shell hoop which tensions the drum head against the drum shell, thereby raising the pitch of the drum.

The present applicant's solution to simplifying tuning was addressed in U.S. Pat. No. 7,138,574. To provide a better understanding of the improvements made to the present invention, a detailed summary of U.S. Pat. No. 7,138,574 is presented below;

U.S. Pat. No. 7,138,574 describes a drum tuning system comprised of a two main components. The first component being a spiral cam ring which is fastened to the cylindrical drum shell and functions as the cam. The spiral cam ring encircles the vertical surface of the drum shell and is fastened in the vicinity near the opened end of the drum shell. The spiral cam ring utilizes a spiraling groove or track around its outside diameter starting at the top of the spiral cam ring spiraling down and exiting at the bottom of the ring forming a shallow angular pitch or ramp.

The second component is made up of a pair of cylindrical rings or annular members. The first ring being a smaller inner counterhoop having both vertical and horizontal surfaces, its vertical surface extending upward, its horizontal surface extending outward on the bottom radially, forming an L cross section.

The second ring being a larger outer rotating actuator ring encompasses the spiral cam ring and has a vertical surface that runs parallel to the spiral groove or track at its outside diameter, and an inward facing horizontal surface atop the vertical surface forming an inverted L cross section. The inward facing horizontal surface of the rotating actuator ring (top) overlaps the inner counterhoops horizontal surface (bottom) and smaller inside diameter of the upward extending vertical surface forming an interlocking L and inverted L cross section. The overlapping horizontal surfaces of the inner counterhoop and the outer rotating actuator ring are separated by bearings or rollers, a ring style retainer is employed to keep the inner counterhoop and outer rotating actuator ring together and assembled to retain the bearings or rollers. These rollers dramatically reduce friction created by the downward force when turning the rotating actuator ring against the stationary inner counterhoop.

The rotating actuator ring engages the track or groove of the spiral cam ring by means of inward facing projections, rollers or wheels mounted on its inside diameter at its vertical surface at opposing intervals and varied heights radially matching the angular ramp on the groove or track of the spiral cam ring keeping them perpendicular to one another. Turning the rotating actuator ring clockwise or counterclockwise has a camming effect which increases or decreases the downward force on the inner counterhoop which bears down on the outer rim of the drum head when fitted over the open end of the drum shell, altering the pitch of the drum thereby tuning it.

This invention mainly focused on the mechanical aspects of altering the tension of a drum head by the most efficient and accurate means possible. Saving the musician time changing drum heads and tuning the drum was the primary focus; its secondary focus was its adaptability to be retrofitted onto existing drums.

SUMMARY OF THE INVENTION

The present invention includes improvements made to the present applicants U.S. Pat. No. 7,138,574 through research and development relating to the design of original drum tuning system. The present invention addresses a variety of important feature improvements that make a musical percussion drum desirable to a musician including sound quality, the method of tuning, an aesthetically pleasing appearance, minimal weight and mass, adjustability, and adaptability.

This drum tuning system provides an extremely simple means of tuning and replacing drum heads. The steps to install a drum head which follows illustrate the simplicity of this device. Attached and encircling the vicinity of the open end of the drum shell is the spiral cam ring, the drum head is fit over the open end of the drum shell, the inner counterhoop is set on the drum head at its outermost circumference at the rim, the rotating actuator is fit over and encompasses the inner counterhoop and by rotating it clockwise the inner facing rollers projecting from the vertical surface of its inside diameter engage the spiral cam rings spiral track and spins freely downward onto the inner counterhoop until the inward facing rollers mounted on the vertical tabs engage the horizontal radial surface of the inner counterhoop. Continued clockwise rotation of the rotating actuator against the inner counter hoop applies downward force on the drum head at its rim and increases the tension of the drum head membrane which tunes the drum. Subsequent clockwise and counterclockwise rotation of the rotating actuator raises or lowers the tension of the drum head to the desired tonal pitch.

Since the mechanical aspects of altering the tension of the drum head by means of a cam mechanism as summarized in the document "Background of the Invention", reference will be made to a "camming mechanism" throughout this document and will not be addressed in detail in the claims of this patent application, only the improvements and critical changes to various components will be. Anywhere in the document where "camming mechanism" is used, the inventor's previous art in U.S. Pat. No. 7,138,574 is implied. In the present applicant's claims in U.S. Pat. No. 7,138,574 the term wheels was implied where the term rollers was used, but since it was not mentioned, throughout this document rollers will also be referred to and understood as wheels. Rollers are wheels, precision bearings, or cam follower bearings.

The new tuning system incorporates a means of grasping the rotating actuator ring by attaching a number of evenly spaced knob-like protrusions having a T shaped cross section to the outside diameter of the rotating actuator ring. A tool having a matching T shaped notch cut into it engages these knobs, which throughout this document will be referred to as radial cleats. This tool has a handle protruding out from it horizontally so that it can be grasped by a hand, or used as a leverage point to turn the rotating actuator ring on its axis. A plate referred to as the radius actuator grip plate is located below the rotating actuator ring and is attached to the camming mechanism and protrudes out from the drum shell. This radius actuator grip plate has a multiplicity of evenly spaced holes are around the size of most people's fingers in it radially so that at least one of the radial cleats will always be lined up with one of them. A drum stick for example could be used as a lever to provide additional mechanical advantage over what a person's hand can exert to turn the rotating actuator ring by inserting it into one of the holes in the radius actuator grip plate and pull against the tool which engages the closest radial cleats.

The new invention incorporates number of vertical tabs or brackets projecting upwards at the top horizontal surface of the rotating actuator ring and are evenly spaced and opposing each other and encircle its diameter. These vertical tabs or brackets have rollers mounted on axles facing inward so that these rollers ride on the horizontal flat of the inner ring or hoop rim which has a cross section shape of an L. The number of separate rollers which project inward from the vertical tabs on the rotating actuator ring that ride on the inner hoop minimizes the contact area where they touch and thereby allows for the maximum resonance when the drum head is struck, another improvement with this invention over its predecessor.

Due to the cylindrical shape of the drum shell and its relatively thin wall thickness, the common belief is less objects bolted to it as well as minimal contact area with the drum will provide better resonance when the drum is struck. Because of this, new lugs have been designed which have a very small footprint on the drum shell.

Due to the range of thicknesses of rims on drum head, being able to lift or lower the "camming mechanism" so that the musician may use a variety of different drum heads serves a very valuable function. A number of these lugs are evenly spaced around the outside diameter of the drum shell at its vertical surface at opposing points radially to evenly spread the load and securely attach the "camming mechanism" to the drum shell. This lug assembly design utilizes a cylindrical eccentric adjuster having an offset bolt or stud running through it horizontally and through the drum shell so it acts as a cam when rotated, which causes the lug assembly to move up or down, thereby raising or lowering the "camming mechanism". This eccentric lug has an o-ring recessed in it and is compressed between the drum shell and itself, providing both grip for the eccentric to securely mate to the drum shell when attached as well as providing for isolation and maximum resonance.

Because the present invention utilizes new eccentric lugs, standard hoop mounting systems which suspend the drum does not fit correctly. To remedy this, a horizontal link having a horizontal threaded hole with a bolt protruding outward from the drum so that it can be supported by suspension mounting system. The suspension mount is semi circular in shape generally having a flat vertical cross section, several evenly spaced and opposing vertical holes have a grommet made of rubber or other flexible materials inserted into the hole to cushion the bolt that is inserted through it. This horizontal method for supporting the drum is designed to provide better isolation than vertically suspended drums by the simple fact that a very small surface area of the bolt actually touches the grommet in the hoop suspension mounting system. This isolation allows the drum to resonate freely and inhibits vibration from one drum from being transferred to another suspension mounted drum in the drum set.

DETAILED DESCRIPTION OF THE PREFERRED EMBODIMENTS OF THE INVENTION

Figure 1:
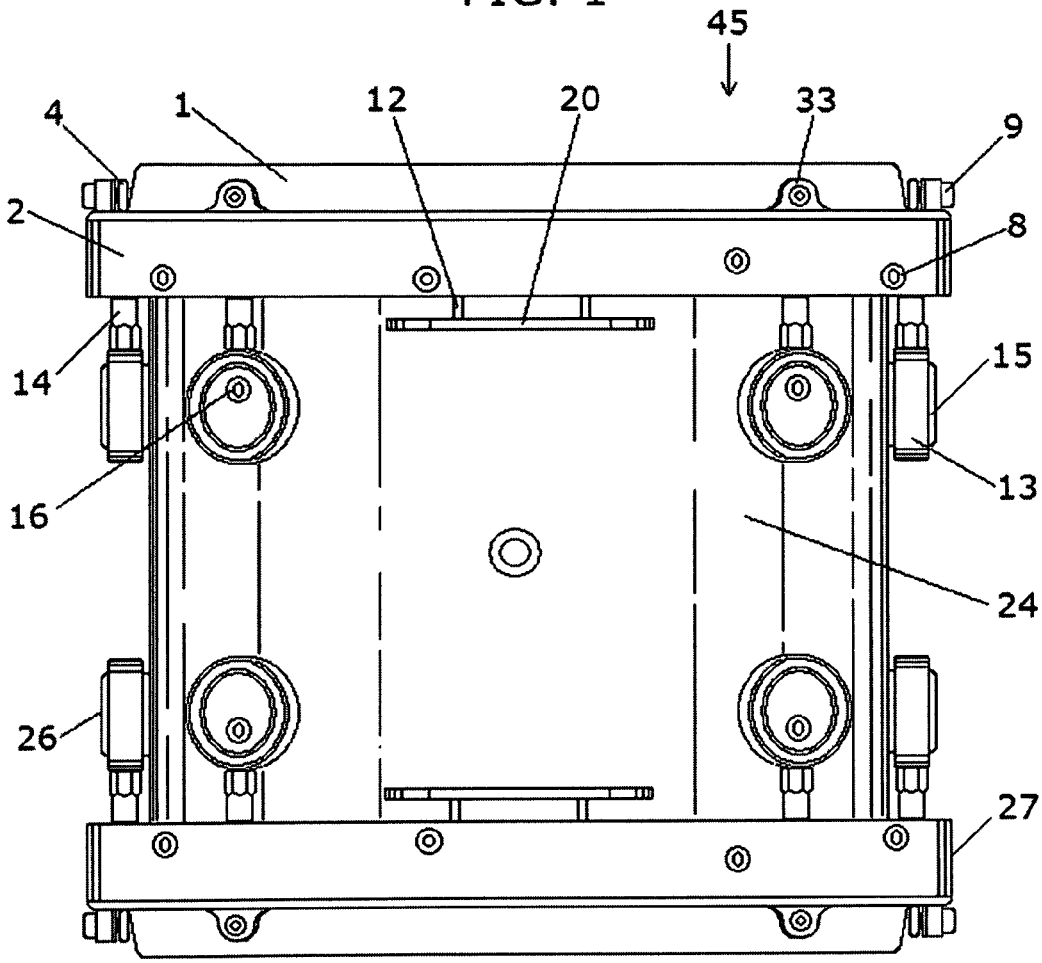
FIG. 1 is a side view of the preferred embodiment of the present invention showing the complete drum tuning system installed on a typical drum shell.

An embodiment of the invention as a whole is depicted in the drawings by reference character 45. An alternative embodiment of the invention as depicted in the drawings by reference character 43. The main components that make up the preferred embodiment of the invention are the counter hoop ring 1, rotating actuator ring assembly 27 which includes counter hoop rollers 4, radial cleats 8, rotating actuator ring rollers 5, spiral cam ring 3, eccentric lug assembly 26, radius actuator grip plate 20, actuator tool 34, and horizontal mounting assembly 42. As mentioned in the Summary of the invention, rollers 4, 5 imply wheels not excluding precision bearings and vice versa.

Figure 3:
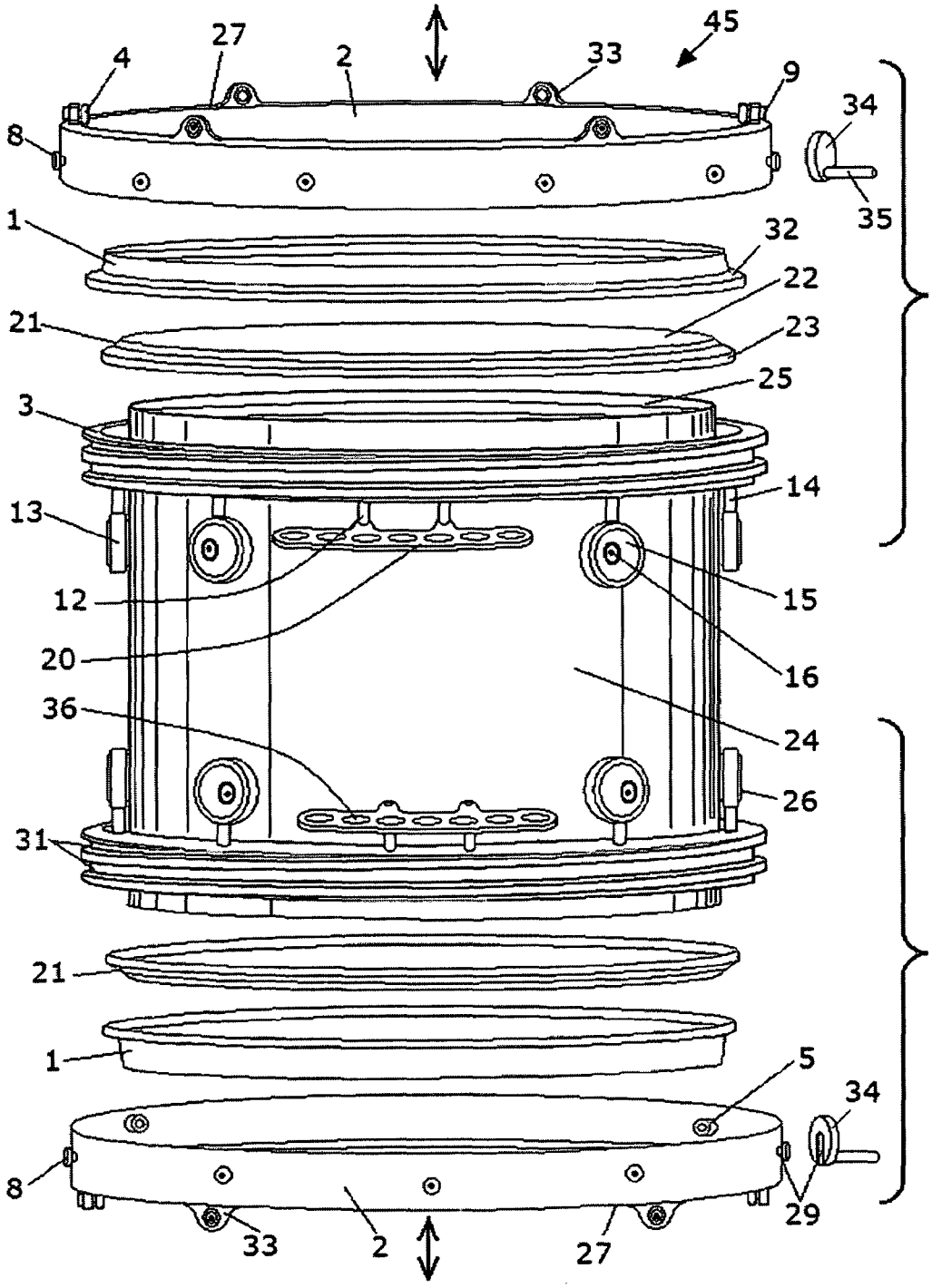
FIG. 3 is an exploded view of the preferred embodiment of the present invention showing the showing the rotating actuator rings, counterhoops, drum heads, and actuator tool separate from the drum. Connected to the drum shell are the eccentric lugs, spiral cam ring and radius actuator grip plate.
Figure 8:
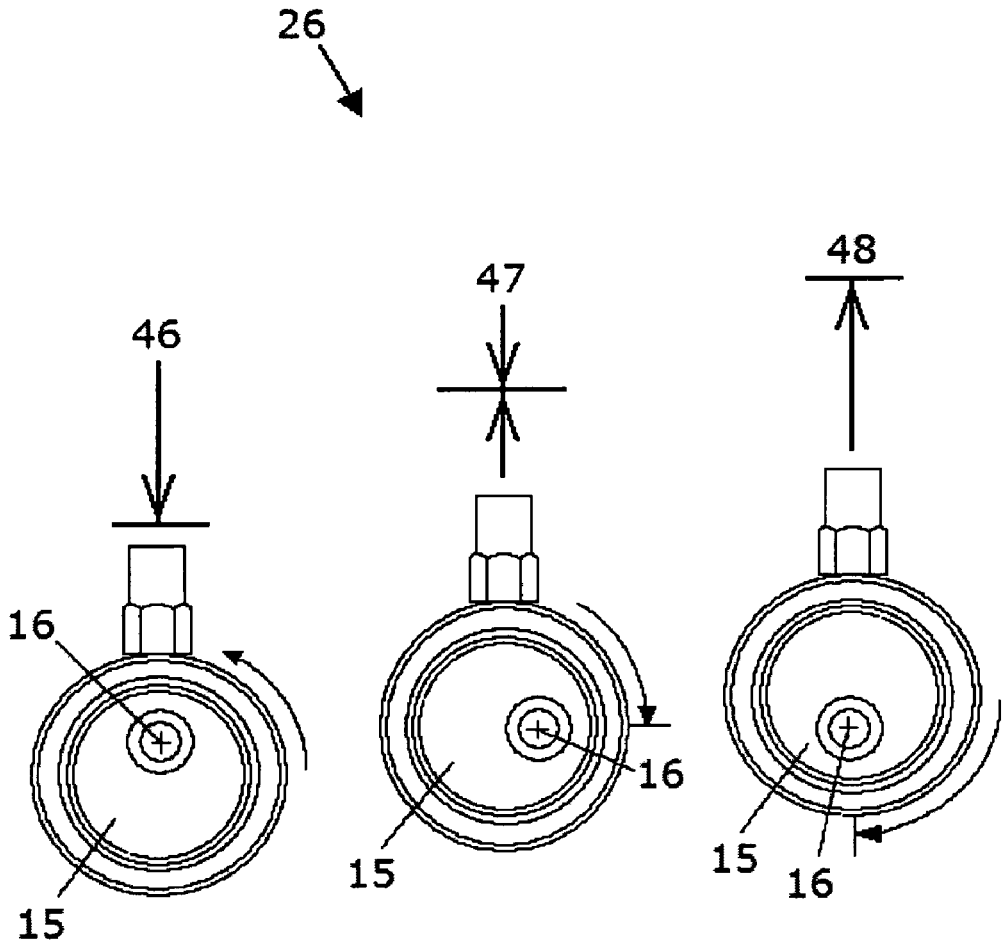
FIG. 8 is a side view of the eccentric lugs adjusted to the lowest, medium and highest settings.
Figure 9:
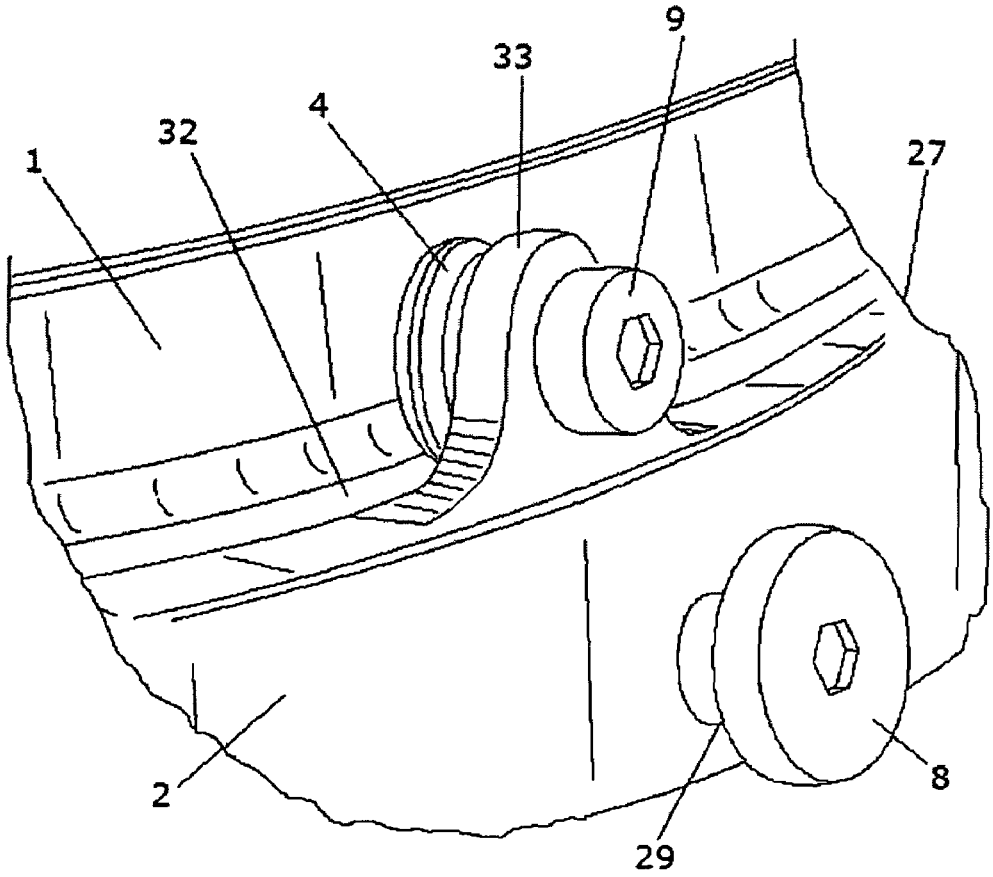
FIG. 9 is a cut away view of the rotating actuator ring and counterhoop clearly showing the radial cleats, counterhoop roller and vertical counterhoop roller tab.

The present invention fully assembled is depicted in FIG. 1. The exploded view of FIG. 3 shows most all of the components that make up the drum 45 which includes a cylindrical drum shell 24 or body with opened ends 25 on each side, drum heads 21 enclosing both open ends 25, a cylindrical inner counter hoop 1 which fits over and bares down on the drum head 21 at the rim 23. A rotating actuator ring 2 rotates clockwise or counterclockwise about the counterhoop 1 as shown in FIG. 9, and the spiral cam ring 3 engaging its annular camming mechanism and varies the tension of the drum head 21. Depicted in FIG. 9, to facilitate rotation of the rotating actuator ring 2, a multiplicity of radial cleats projecting outward from its the vertical surface radially so a rotator tool 34 may be used along with the outward projecting radius actuator plate 20 which acts as an anchoring point on the drum. FIG. 8 illustrates the Eccentric lugs 26 and how they function to move the spiral cam ring 3 upwards and downwards to allow for a wide range of drum heads 21 to be used.

Figure 4:
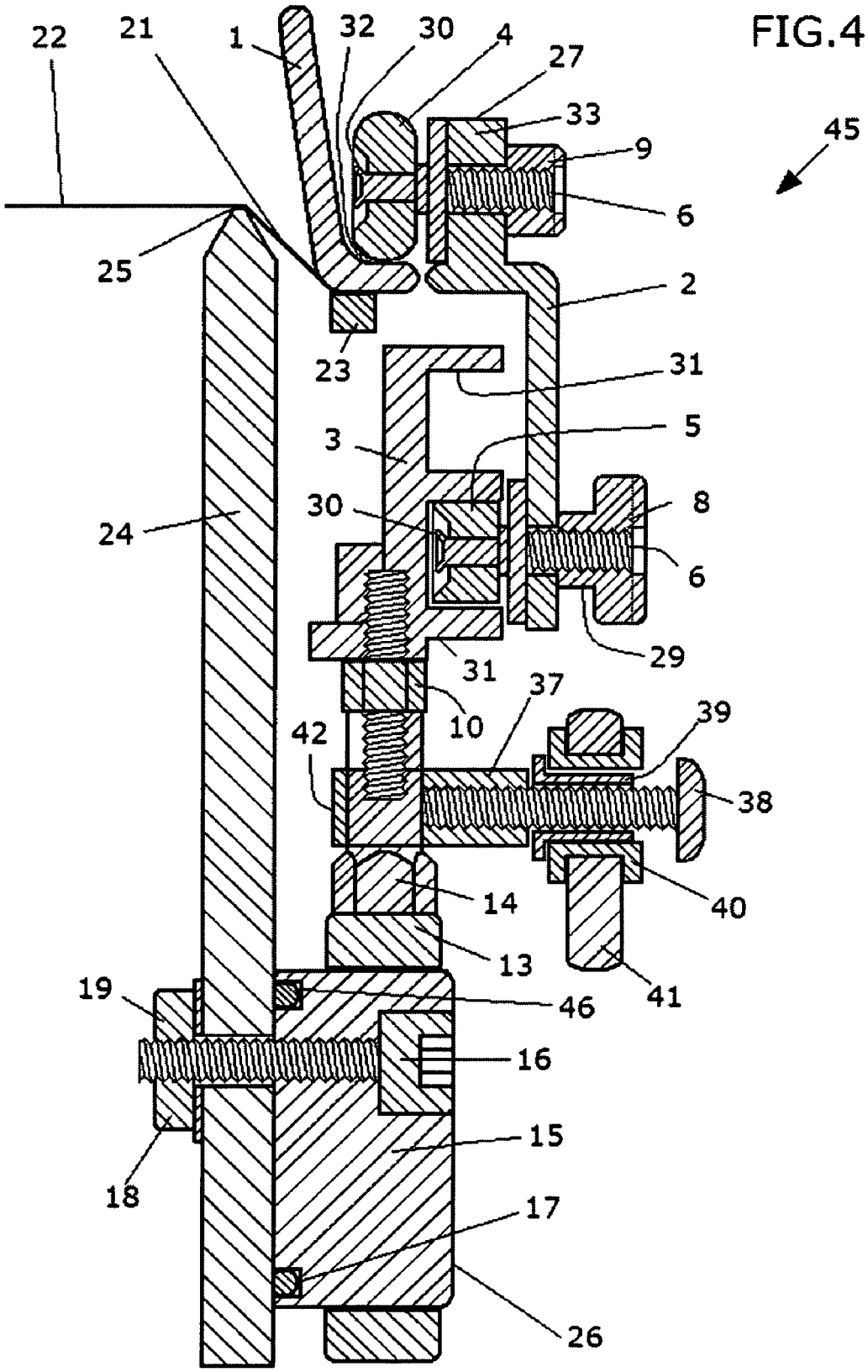
FIG. 4 is a detailed cross sectional view of the preferred embodiment of the present invention as shown in FIG. 1 and FIG. 3.

As shown in cross section drawing FIG. 4, the inner counterhoop 1 has an "L" cross section profile possessing both vertical and horizontal surfaces; its vertical surface extends upward and away from the drum head 21, the other surface having an outward extending horizontal surface radially for rollers 4 to ride on. To increase rigidity and horizontal stiffness to keep the counterhoop as round as possible, its vertical surface forms an opened ended cylindrical cone, its inside and outside diameters smaller at its top and larger at its base at the axis where the horizontal and vertical surfaces meet. The cone shape also aids in aligning the rotating actuator ring 2 when fitted over the top of it during the installation of a drum head 21. At the inner counterhoops vertical surface where it converges with the outward facing horizontal surface 32 is a concave surface which also adds to the stiffness and functions as a guide for the inward facing rollers mounted on the vertical tabs 33 on the rotating actuator ring 2.

The inner counterhoop 1 is surrounded by the rotating actuator ring 2 as depicted in FIG. 4 which has an "Inverted L" cross section profile possessing both vertical and horizontal surfaces, atop the vertical surface is a horizontal surface facing inward radially and is larger in diameter than the outside diameter of the inner counterhoops outer extending horizontal surface. Protruding upward from the horizontal surface of the rotating actuator ring are evenly spaced and opposing vertical tabs 33 around the top diameter of its body, each tab having inward facing vertically mounted counter hoop rollers 4 mounted to axles 6 secured in place by nuts 9, these rollers ride radially on the horizontal surface 32 of the smaller inner counter hoop ring 1. Clearly shown in FIG. 4, the inner counterhoop and rotating actuator ring do not overlap in any way, these rollers 4 mounted on axles 6 form a bridge between the inner hoop 1 and the rotating actuator ring 2 providing minimal contact between the inner hoop 1 and the drum tuning system 45 therefore allowing maximum resonance. The rotating actuator rings vertical surface runs parallel to and encircles the vertical surface of the outside diameter of the spiral cam rings track or groove 31 also shown in FIG. 4.

The vertical surface at the inside diameter of the rotating actuator ring 2 as shown in FIG. 4, has inward facing rollers 5 which engage the spiral cam rings 3 cam track or groove 31, which encircles the drum shell 24 or body just below the opened end 25. Best illustrated in FIG. 3 the spiral cam ring 3 utilizes a continuous track or groove 31 around its outside diameter which starts at the top and spirals downward and exits at the bottom of the spiral cam ring 3. Because the spiral cam rings 3 track or groove 31 forms a ramp having an angular profile, the rollers 5 are located at opposing intervals and mounted at varied heights so that the rotating actuator ring 2 and spiral cam ring 3 remain perpendicular in relation to one another. The rotating actuator ring 2 fits over and encompasses the spiral cam ring 3, and when rotated clockwise or counterclockwise, the inward facing counter hoop rollers 4 engaging the track or groove 31 on the spiral cam ring 3 cause the rotating actuator ring 2 to move towards or away from the open end 25 of the drum shell 24 due to the ramp or angle of the track 31 spiral cam ring 3. The inward facing and opposing counter hoop rollers 4 attached to the vertical tabs 33 allow for free movement of the rotating actuator ring 2 as they roll on and engage the horizontal radial surface 32 as shown in the cut away view of FIG. 9, of the stationary inner counter hoop 1 at its outer circumference, causing the inner counterhoop 1 to bear down with greater or lesser force on the rim 23 of the drum head 21, thereby increasing or decreasing the tension on the drum heads membrane 22 which is stretched over the end 25 of the drum shell 24 or body and tunes the drum 45.

Figure 10:
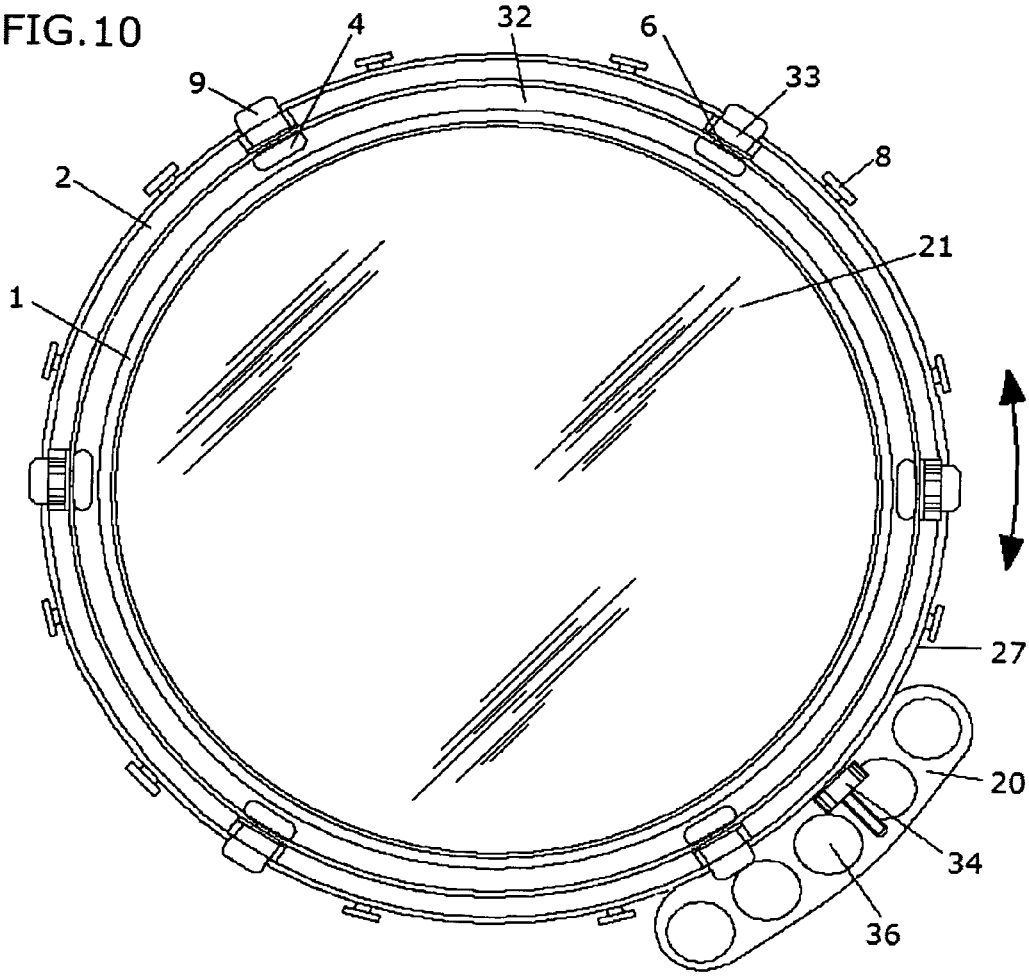
FIG. 10 is a top view of the preferred embodiment of the present invention showing the drum head, counterhoop, rotating actuator ring assembly, actuator tool, and radius actuator grip plate.

Best shown in the top view in FIG. 10, rotation is achieved by means of a number equally spaced radial cleats 8 projecting outward from the vertical surface of the outside diameter of the rotating actuator ring 2 radially, threaded onto stub shafts 7 and the axle shafts 6 with inward facing rollers and function as nuts. These radial cleats 8 as seen in FIG. 4, have a T cross section 29 which provide a secure method for the actuator tool 34 to grasp the rotating actuator ring 2 and rotate it on its axis.

Figure 5:
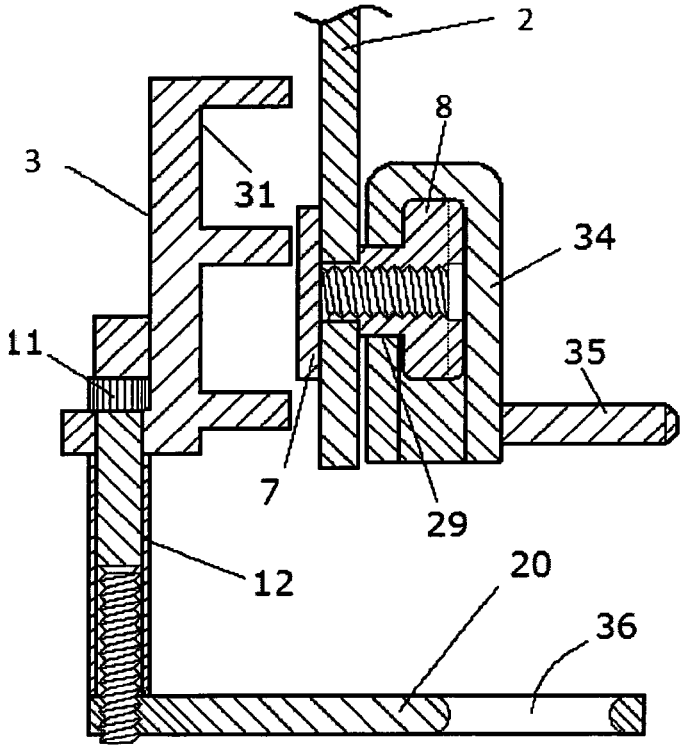
FIG. 5 is a detailed cross sectional view of the preferred embodiment illustrating the radius actuator grip plate attached to the spiral cam ring, and the rotator tool engaged with the radial cleats.
Figure 6:
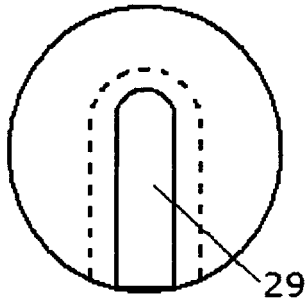
FIG. 6 is the back view of the actuator tool showing the T groove cut into it for engagement with the T cross section of the radial cleats.
Figure 7:
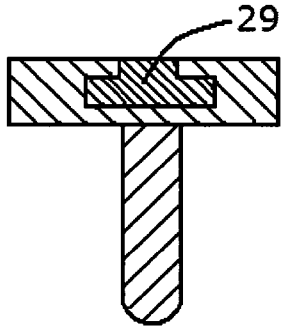
FIG. 7 is the underside view of the actuator tool showing the T cross section cut into it for engaging the radial cleats.

The actuator tool 34 shown in FIGS. 5, 6 and 7, has a matching T cross sectional slot 29 for engaging and locking onto the radial cleats, and a horizontal handle 35 which may be moved by hand, or leveraged with a drum stick or the like for additional mechanical advantage.

To act as an anchoring point on the drum 45, a plate referred to as the radius actuator grip plate 20 seen in FIGS. 3, 5 and 10, is located below the rotating actuator ring 2 and is attached to the cam ring 3 using bolts 11 and spacer bushings 12 and protrudes out from the drum shell 24. This radius actuator grip plate 20 has a series of evenly spaced holes 36 in it, best shown from the top in FIG. 10, so that at least one of the radial cleats 8 will always be lined up with one of them. These holes 36 are around the size of most people's fingers and light tensioning of the drum head 21 can be achieved by hand. When more tension is required, a drum stick for example could be used as a lever to turn the rotating actuator ring 2 by inserting it into one of the holes 36 in the radius actuator grip plate 20 and pull against the actuator tool 34 which engages the closest radial cleats 8 and rotates the rotating actuator ring 2.

Because drum heads 21 vary in thickness at the rim 23 which is the outermost part of the drum head 21, the spiral cam ring 3 is attached to the drums shell 24 or body utilizing a number of equally spaced adjustable eccentric lugs 26 shown in FIGS. 1, 3 and 4. Each eccentric lug assembly 26 shown in FIGS. 4 and 8, is made up of a perch shaft 14 protruding vertically from an ring lug 13 which is parallel to the vertical surface of the drum shell, and an inner eccentric lug 15 which has an offset bolt or stud 16 running through it horizontally passing through the drum shell 24, on the inner vertical surface of the eccentric lug 15 is a groove 46 with an o-ring 17 which provides for both grip and isolation when secured by a washer 18 and locknut 19 parallel to the vertical surface of the drum shell 24. As depicted in FIG. 8, the inner eccentric lug 15 acts as a cam and rotation of it causes the spiral cam ring 3 to be raised or lowered.

Figure 2:
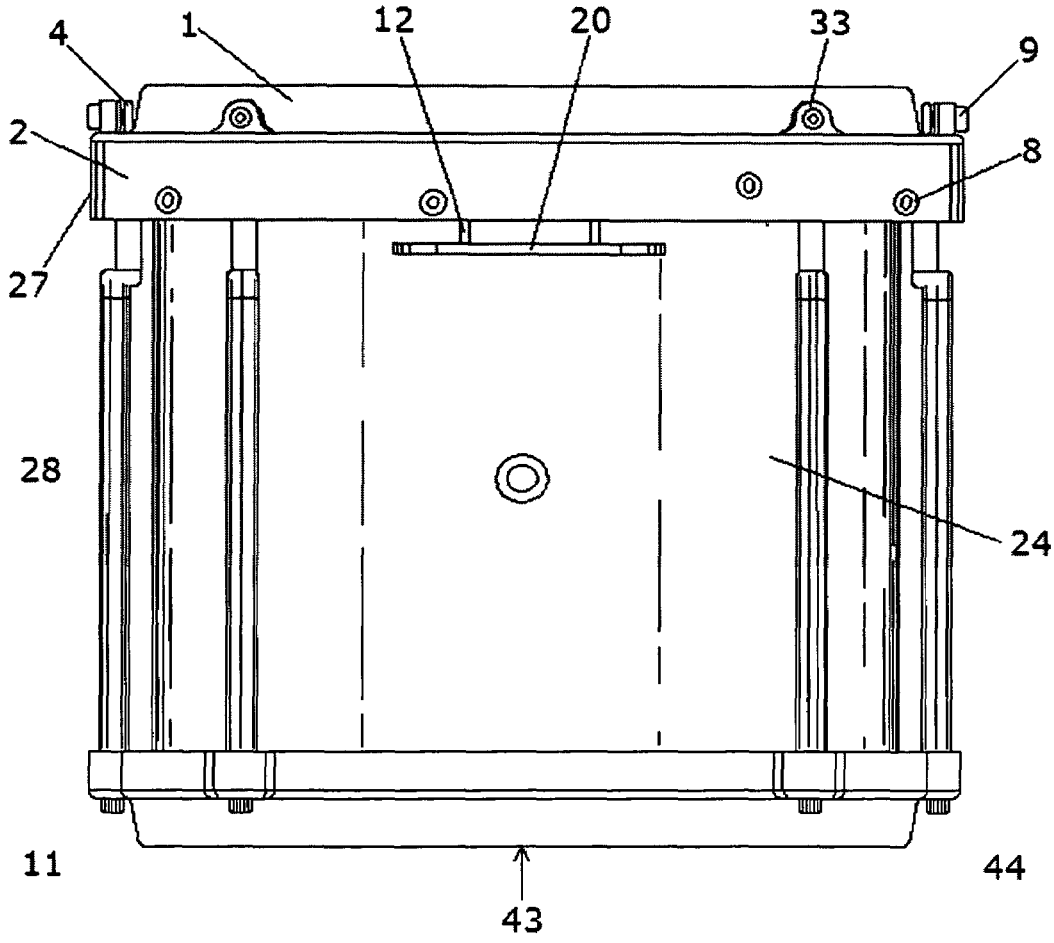
FIG. 2 is a side view of an optional embodiment of the present invention utilizing what is commonly referred to as a "full floating drum".

FIG. 2 shows an alternate version of this tuning system utilizes what has been referred to as a Full Floating Drum 43 which means that the drum shell 24 has no holes drilled in it and is sandwiched in between two drum heads 21. Tensioning one side of the drum tuning system alters the tension of both drum heads 21 simultaneously and is a very simple way to tune drums. This is often used with marching band drums and is an acceptable way to tune drums. With this version, the present invention including a counter hoop 1, rotating actuator ring 2 having vertical tabs 33 with all the components attached to it as previously mentioned above in the preferred embodiment, a spiral cam ring 3 and radius actuator grip plate 20 are employed on just one side of the drum and functions in exactly the same way the drum tuning system described above does. The opposite end of the drum utilizes a standard hoop 44 that can be found an all conventional drums and is connected by bolts 11 to a matching number of pull rods 28, once attached are not adjustable. The spiral cam ring 3 is bolted to the opposite end of the pull rods 28, which resembles a bird cage when assembled. A drum head 21 is placed in the bottom hoop 44, and then the drum shell 24 is inserted down in between the surrounding pull rods 28 until it comes in contact with the bottom drum head 21. The top drum head 21 is placed over the open end 25 of the drum shell 24 and the counter hoop 1 is seated on the drum rim 23, and the rotating actuator ring 2 engages the spiral cam rings 3 track 31 and the drum is tensioned using the radial cleats 8, actuator tool 34 and the radius actuator grip plate 20 as mentioned previously. This design is extremely simple and provides a fast way to change both drum heads 21 or drum shells 24 if desired.

In the case of a Tom Tom drum, which is generally attached to a suspension mounting system 41 for use with a drum set, a special horizontal mounting link 37 shown in cross sectional view FIG. 4, was required because the present invention utilizes all new eccentric lugs 26, depicted in FIGS. 1, 3 and 8, and standard hoop mounting systems 41 which suspend the drum 45, 43 do not fit correctly. This horizontal mounting link 37 has a hole threaded horizontally which intersects with another hole drilled through it vertically and is clamped to the vertically attached perch stud shaft 14 of the eccentric lug assembly 26 by means of threading a bolt 38 through the threaded horizontal hole, thereby securely clamping it in place. The horizontal mounting bolt 38 is longer than the depth of the horizontal thread in the horizontal link 37 and protrudes outward from the drum 45, 43 so that it can be supported by suspension mounting system 41.

The suspension mounting systems 41 are generally semi circular in shape like a half moon, and have a flat vertical cross section seen in FIG. 4, several evenly spaced and opposing holes are drilled horizontally through it so that a grommet 40 made of rubber or other flexible materials may be inserted into the hole to cushion the bolt 38 and bushing 39 that is inserted through it. Isolation is important because sound quality is poor when vibration transference occurs with other drums as well as vibration absorption which chokes off and decays sound. This horizontal method for supporting the drum 45, 43 is designed to provide better isolation than vertically suspended drums by the simple fact that a very small surface area of the bolt 38 actually touches the grommet 40 in the hoop suspension mounting system 41. This isolation allows the drum 45, 43 to resonate freely.

What is claimed is:

1. A drum comprising a cylindrical shell, a drum head fitted over the open end of the cylindrical drum shell, a drum tuning system utilizing a tuning system made of steel, aluminum, metallic, or other rigid materials, which employs a camming mechanism that is rotated clockwise or counterclockwise in the vicinity of the open end of the said cylindrical drum shell to alter the tension of said drum head; said drum tuning system comprised of an inner cylindrical counterhoop fitted radially over the rim on the drum head, said inner counterhoop surrounded by a cylindrical rotating actuator ring larger in diameter than the said inner counterhoop and said drum head, said rotating actuator ring having a multiplicity of equally spaced vertical tabs projecting upward from the horizontal surface atop its vertical cylindrical surface, said vertical tabs opposing each other radially around its diameter, said vertical tabs connecting inward facing wheels or rollers, said rollers having a round cross section at their rolling surface, ride on the horizontal surface of the of said inner counterhoop, said rotating actuator ring functioning as a cam when rotated clockwise or counterclockwise on the axis of the open end of the drum shell acting upon a camming mechanism, rotation occurring by means of a multiplicity of radial cleats attached to the vertical surface on the outside diameter of the rotating actuator ring, a tool having a handle engages the radial cleats and is used in conjunction with a radius actuator plate, which acts as an anchoring point on the drum to move the rotating actuator clockwise or counterclockwise; eccentric lugs positioned around the vertical surface of the outside diameter of the drum body in order to raise and lower the drum tuning system to provide a range of adjustment vertically in the vicinity of the open ends of the drum shell, horizontal mounting links connected to the eccentric lugs employ bolts which project radially outward from the drum to suspend the drum from a mounting system to be played by the musician.

2. A drum according to claim 1 having a separate cylindrically shaped rotating actuator ring, said rotating actuator ring having both vertical and horizontal surfaces, said rotating actuator ring having an inverted L cross sectional profile, said rotating actuator rings vertical surface parallel to the vertical surface of the cylindrical drum shell, said rotating actuator ring encircling said cylindrical drum shell in the vicinity of the open end of said drum shell, said rotating actuator having an inward facing horizontal surface atop its vertical surface, said horizontal surface having a multiplicity of equally spaced vertical tabs projecting upward and opposing each other radially around its diameter, said vertical tabs having holes accepting axles having inward facing wheels or rollers, said axles attached to said vertical tabs by nuts, said wheels or rollers positioned vertically possessing a round cross section at their outside diameter on the rolling surface so that they can ride on the horizontal surface of the of inner counterhoop at its outer circumference; said rotating actuator ring having a larger inside diameter at its horizontal surface than the outside diameter of said inner cylindrical counterhoops outermost horizontal surface, said rotating actuator ring and said inner counterhoops horizontal surfaces not overlapping each other, said rotating actuator ring functioning as a cam when rotated clockwise or counterclockwise in the vicinity of the open end of the drum shell acting upon a camming mechanism attached to the said drum shell.

3. A drum according to claim 1 having a Counterhoop having both vertical and horizontal surfaces forming an L cross section, said counterhoop having a smaller inside diameter at the top of the vertical surface than at its bottom, said counterhoops vertical surface leaning inward at its top forming an open cylindrical cone shape, said cone shape converging at the axis where the horizontal surface extends outwardly radially, said horizontal surface functioning as a flange for wheels or rollers to ride on, said vertical and horizontal axis having a radius or concaved shape at its outer surface to act as a guide for inward facing wheels or rollers attached to the rotating actuating rings vertical tabs, said wheels or rollers touching the concaved portion where the vertical and horizontal surfaces meet to keep the hoop aligned in relation to the open end of said cylindrical drum shell.

4. A drum according to claim 2 having a Counterhoop with a groove or track in the horizontal surface for wheels or rollers to ride in, said groove functioning as a guide to align said Counterhoop properly as wheels or rollers roll about the horizontal surface radially when engaging the rim of the drum head when fit over the open end of the cylindrical drum shell.

5. A drum as according to claim 1 having a multiplicity of radial cleats projecting outwardly from the outer circumference of the rotating actuator rings vertical surface; said radial cleats generally round in shape having a T cross section to act as a locking mechanism to facilitate rotation of said rotating actuator ring.

6. A drum as according to claim 1 having a radius actuator plate extending outwardly from the drum shell below said camming mechanism, cylindrical inner hoop cylindrical rotating actuator ring, said plate forming a partial circle or fractional radius larger than the outside diameter of said rotating actuator ring, said radius actuator plate having a number of holes passing through its horizontal surface to be used as anchor points for the musicians fingers or other leveraging tools such as a drum stick.

7. A drum according to claim 1 having a tool which engages the radial cleats of claim 2; said tool having a "T" cross section notched into it vertically for engaging and locking onto the matching "T" cross section of the radial cleats; said tool having a horizontal projecting handle for the musicians fingers to grab or used as a leverage point for a lever such as a drum stick for greater mechanical advantage; said tool working in conjunction with the radius actuator plate as mentioned in claim 3 as an anchor point to rotate the rotating actuator ring to tune the drum.

8. A drum according to claim 1 having a multiplicity of eccentric lugs; said eccentric lugs having a vertical perch attached to underside of the horizontal surface of the "camming mechanism", the other connected to or part of an outer lug ring, its surface running is parallel to the vertical surface of the drum shell, said lug ring encircling or surrounding a cylindrical inner eccentric lug projecting outward horizontally from the drum shell, said inner eccentric lug having a bolt or stud threaded through it horizontally, said stud or bolt being offset from the center of the said inner eccentric lug, said bolt or stud passing through a hole in the drum shells vertical surface, said inner eccentric lug having an o-ring fitted into a groove on the inner facing vertical surface to provide grip where attached to the vertical surface of said cylindrical drum body as well as function as a buffer for vibration when the drum is played, said inner eccentric lug being rotatable clockwise or counterclockwise functioning as a cam to act upon the said outer lug ring and said vertical perch, causing the spiral camming mechanism to be raised and lowered to accommodate a variety of thicknesses of drum heads.

9. A drum according to claim 1 utilizing horizontally mounted links mounted to the eccentric lugs used to suspend the drum, or mount the drum in a stand and positioned such that the musician can play it, said horizontal mounting link having a hole threaded horizontally intersecting with another hole drilled through it vertically and is clamped to the vertically attached perch stud shaft of said eccentric lug assemblies by means of threading a bolt through the threaded horizontal hole, thereby securely clamping it in place; said horizontal mounting bolt is longer than the depth of the said horizontal thread in said horizontal link, protruding outward from the drum, said horizontal bolt passing through grommets made of rubber or other flexible material inserted into several evenly spaced horizontally drilled holes through the vertical wall of a half mooned shaped suspension mounting system which encircles the drum in the vicinity of the opened end of said drum shell.

* * * * *